US005600926A

United States Patent [19]

Ehrlich

[11] Patent Number: 5,600,926

[45] Date of Patent: Feb. 11, 1997

[54] PANEL CONNECTING ARRANGEMENTS

[75] Inventor: Michael F. Ehrlich, Oakmont, Pa.

[73] Assignee: Furniture Source International Inc., Pittsburgh, Pa.

[21] Appl. No.: 550,672

[22] Filed: Oct. 31, 1995

[51] Int. Cl.[6] ..... E04H 3/00

[52] U.S. Cl. ..... 52/239; 52/238.1; 160/135; 160/351

[58] Field of Search ..... 52/239, 238.1, 52/243, 281, 36.6, 282.1, 36.1, 36.4, 36.5, 282.2; 160/135, 351; 312/263, 265.5, 257.1; 211/184

[56] References Cited

U.S. PATENT DOCUMENTS 5,134,826 8/1992 La Roche et al. ..... 52/281 X
5,255,478 10/1993 Baranowski et al. ..... 52/239 X
5,274,970 1/1994 Roberts ..... 52/239 X
5,377,466 1/1995 Insalaco et al. ..... 52/239 X
5,487,246 1/1996 Hodges et al. ..... 52/239 X

*Primary Examiner*—Creighton Smith
*Attorney, Agent, or Firm*— Webb Ziesenheim Bruening Logsdon Orkin & Hanson, P.C.

[57] ABSTRACT

An off module connecting arrangement for connecting remanufactured office wall panels to modern wall panels which includes a bracket system for cooperation with modified existing panel finished ends. The bracket system includes an upper bracket and a lower bracket which are secured to the modern panels anywhere along the length of the panel. The brackets include hooks that engage with slots in the modified panel finished ends and connectors for connecting the brackets to a modern panel.

23 Claims, 8 Drawing Sheets

PANEL CONNECTING ARRANGEMENTS

BACKGROUND OF THE INVENTION

1. Field of the Invention

The invention relates generally to office panel systems and, in particular, to connecting arrangements for connecting remanufactured office panels to new modern office panels.

2. Description of the Prior Art

Office panel systems are currently manufactured by a number of different companies, such as, for example, Teknion Furniture Systems Inc., located in Downview, Canada; Steelcase Inc., located in Grand Rapids, Mich.; and Haworth, Inc., located in Holland, Mich.. Many existing systems are worn from long use but can be remanufactured to look substantially new. Remanufactured office panels and auxiliary equipment for use therewith are substantially less expensive than new panels and new auxiliary equipment which permits a company to install a new office panel system at a substantially lower cost. It also allows a company which owns an office panel system to have at least a portion of the system remanufactured for reuse instead of completely replacing it.

A problem which exists with the older office panel systems is that the panels are not designed to accommodate today's electric wiring and communication cabling requirements. The new office panel systems, such as are disclosed in U.S. Pat. Nos. 5,214,890; 5,277,005; and 5,277,007 owned by Teknion Furniture Systems, Inc., meet today's wiring and cabling requirements. Additionally, the new office panel systems provide wiring and cabling raceways at desk top height for easy access to plugs for electric power and communication cabling. Therefore, companies can purchase new Teknion panels for use with remanufactured panels.

SUMMARY OF THE INVENTION

The invention is an arrangement for connecting panels in office panel systems. The connection of the end of one panel to the face of a second panel may be located at any point along the length of the second panel intermediate the ends of the second panel. The invention has particular application in connecting used panels manufactured by Steelcase and Haworth to panels such as those manufactured by Teknion. This results in an office panel system having remanufactured panels to reduce the cost of the system and having Teknion panels to provide state of the art wiring and cabling capabilities. The arrangement may be used to connect office panels made by manufacturers other than Steelcase, Haworth and Teknion at locations intermediate the ends of the panels.

A complete understanding of the invention will be obtained from the following description when taken in connection with the accompanying drawing figures wherein like reference characters identify like parts throughout.

DETAILED DESCRIPTION OF THE PREFERRED EMBODIMENTS

Figure 1:
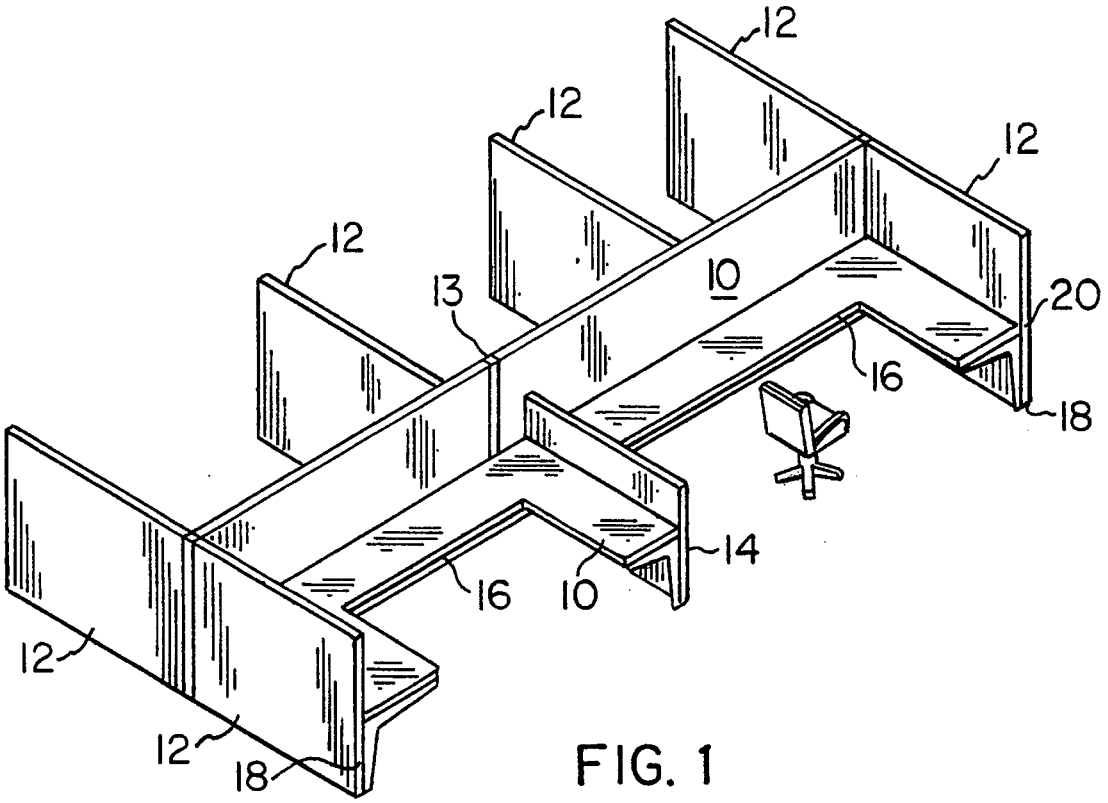
FIG. 1 is a perspective of an office panel system.
Figure 2:
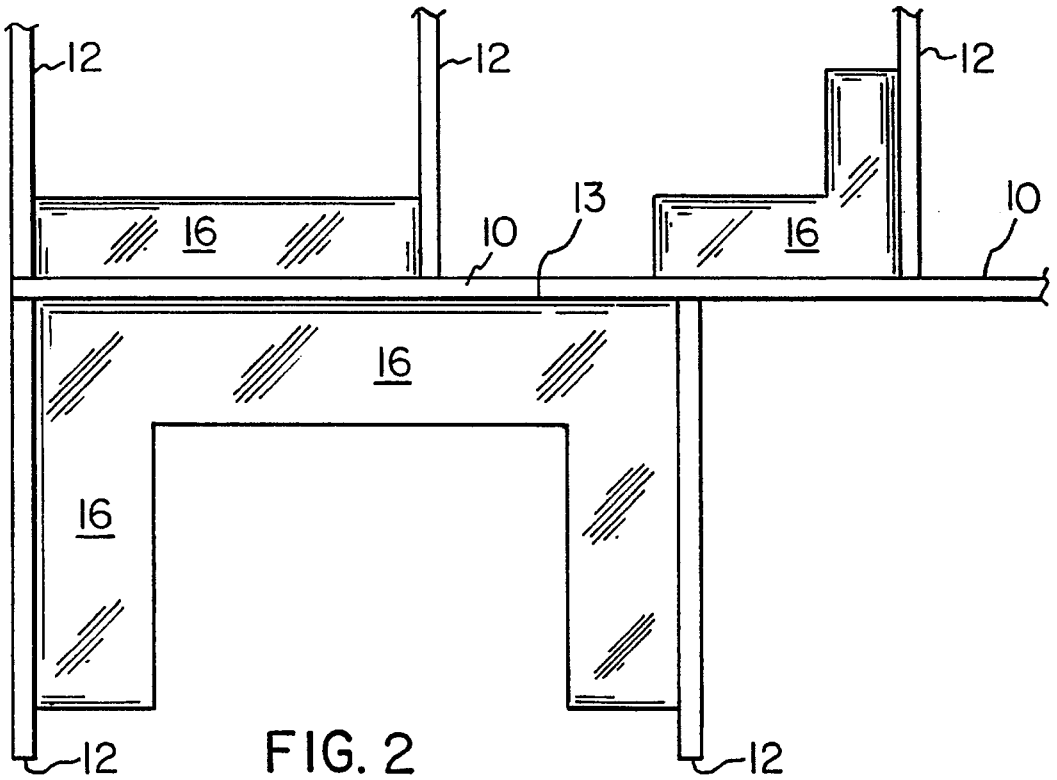
FIG. 2 is a plan view of an office panel system.

The office panel system shown in FIGS. 1 and 2 of the drawings includes a plurality of Teknion panels 10 connected at 13 to form the spine of an office panel system. Dividing panels 12 extend at right angles from the spine to form the walls of individual office units. The Teknion panels include a raceway at desk top height for power, communication and data cables (not shown). Dividing panels 12 are remanufactured Steelcase panels or remanufactured Haworth panels. A short dividing panel 14 may also be used in the office panel system. The dividing panels 12 and 14 are connected to the Teknion panels of the spine 10 by off module interface connecting arrangements, which are described in detail hereinafter. Different embodiments of off module interface connecting arrangements allow for either a Steelcase panel or a Haworth panel to be connected to a Teknion panel 10 at any desired position along the length of the spine to define different sized office units. Desks 16 and other furniture may be connected to the panels as desired.

Figure 3:
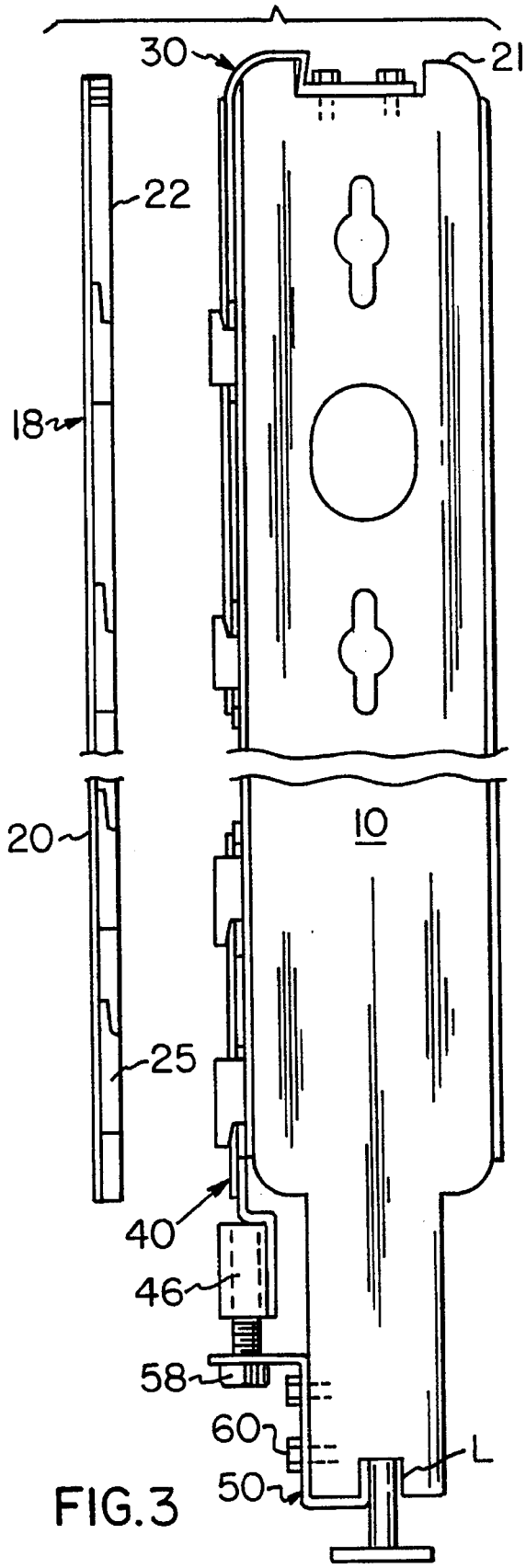
FIG. 3 is an exploded end view of a Teknion panel with a connecting bracket attached thereto and a modified finished end for a Steelcase panel.
Figure 4:
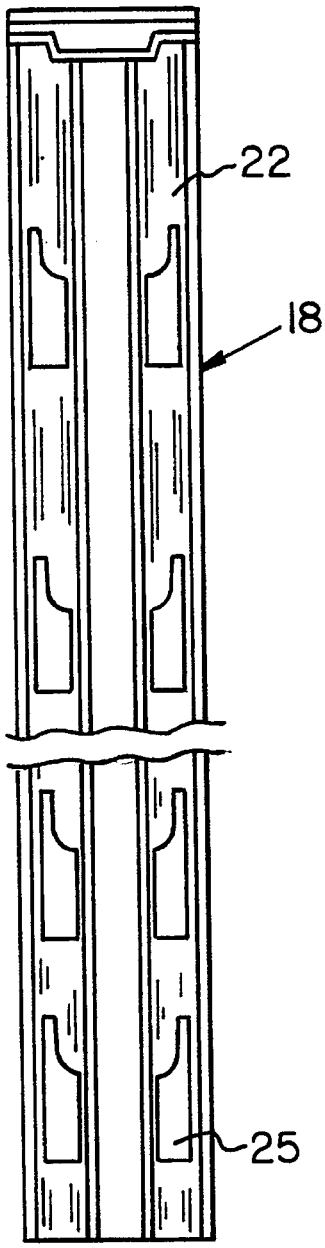
FIG. 4 is an elevation of a modified finished end for use with a Steelcase panel.
Figure 5:
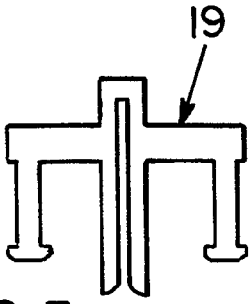
FIG. 5 is an end view of a flexible connecting hinge for use with Steelcase finished ends.
Figure 6:
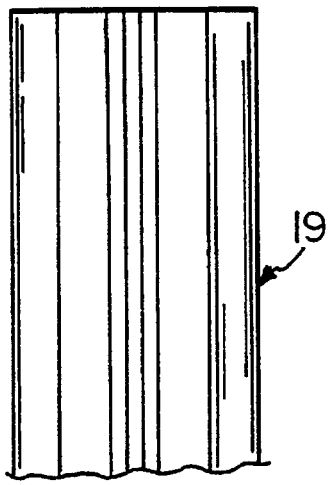
FIG. 6 is a broken plan view of the hinge shown in FIG. 5.
Figure 7:
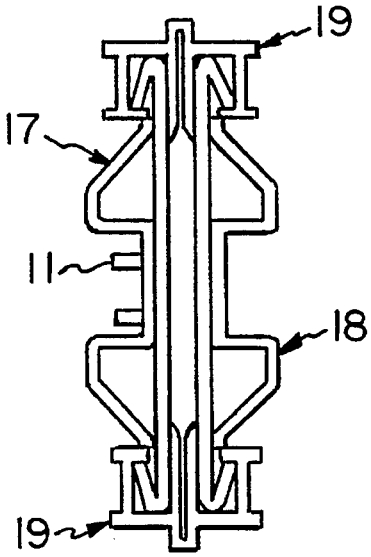
FIG. 7 is an end view of a standard Steelcase finished end connected to a modified Steelcase finished end.

FIG. 3 of the drawings shows an off module interface connecting arrangement for connecting a remanufactured Steelcase panel 12 to a Teknion panel 10. A modified Steelcase finished end 18 is shown in FIGS. 3 and 4. FIGS. 5 and 6 show a flexible hinge 19 for connecting opposed Steelcase finished ends. FIG. 7 shows an end view of a standard Steelcase finished end 17 which includes studs 16 connected to a modified Steelcase finished end 18 such as shown in FIG. 4 by hinge members 19. The opposed surfaces 20 of the finished ends are smooth. As shown in FIG. 4 of the drawings, the opposite surfaces 22 of the finished ends 17 and 18 have slots 25 that engage hook like protrusions located on the end rail of a Steelcase panel 12 or on hooks located on the upper and lower mounting brackets 30 and 40. The Steelcase finished end 18 shown in FIG. 7 is a modified finished end by removing the studs 11, which are used to direct a jack bolt when the finished end is connected to an end rail of a Steelcase panel end rail. A flexible extruded hinge 19 is shown in FIGS. 5 and 6 of the drawings for connecting the finished ends 17 and 18 together with the surfaces 20 facing each other. The opposite surface 22 of unmodified finished end 17 engages the end rail of Steelcase panel 12 and surface 22 of the modified finished end 18 and is formed with slots 25 which engage hooks on upper and lower brackets 30 and 40 that are mounted on a Teknion panel 10 to provide an off module right angle interface connection between a Steelcase panel 12 and a Teknion panel 10.

Figure 11:
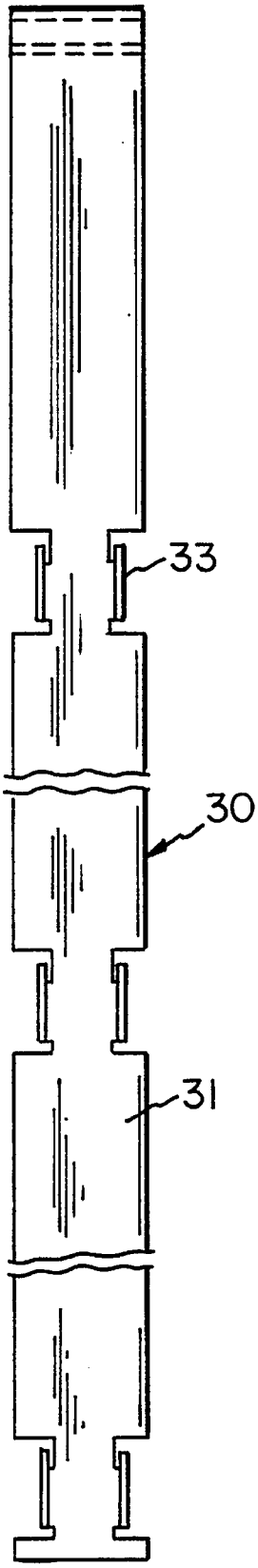
FIG. 11 is a front view of an upper connecting bracket without a strengthening rib.
Figure 12:
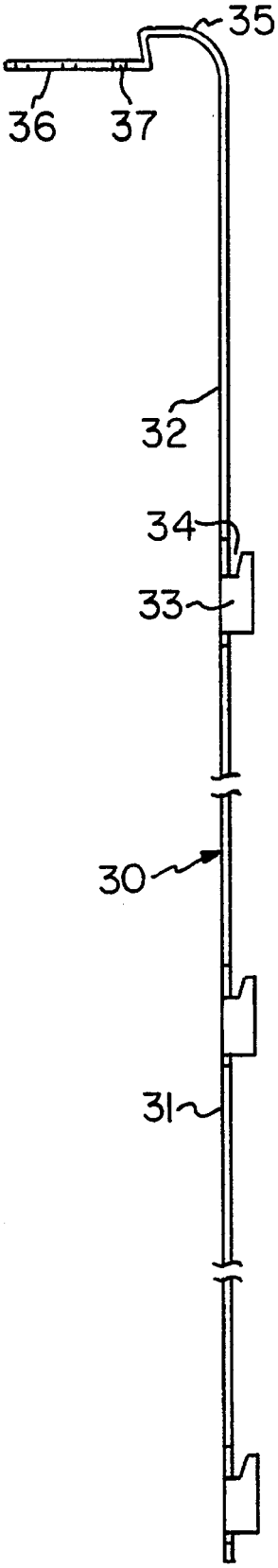
FIG. 12 is an end view of the upper connecting bracket shown in FIG. 11.

As shown in FIGS. 3, 11 and 12 of the drawings, upper bracket 30 has a lower substantially straight section 31 having a contact surface 32 that lies adjacent to the surface 15 of a Teknion panel 10 and includes a plurality of longitudinally spaced paired hooks 33 having notches 34 punched from the material of the bracket. The notches 34 open upwardly to engage the edges of slots 25 on the opposite surface of modified finished end 18. Upper bracket 30 has an upper curved portion 35 which fits over the rounded top edge of the Teknion panel 10. A flat extension 36 steps down to contact the upper surface of a notch N in the upper end of the Teknion panel 10. A plurality of holes 37 are formed in the flat extension 36 to receive screws for securing the upper bracket 30 to the upper edge of the Teknion panel 10.

Figure 10:
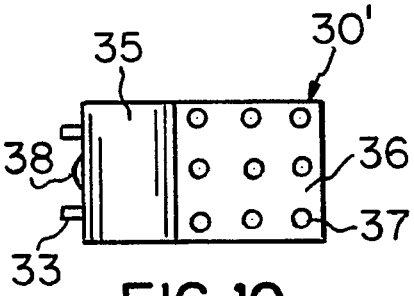
FIG. 10 is a top view of the upper connecting bracket shown in FIGS. 8 and 9.
Figure 8:
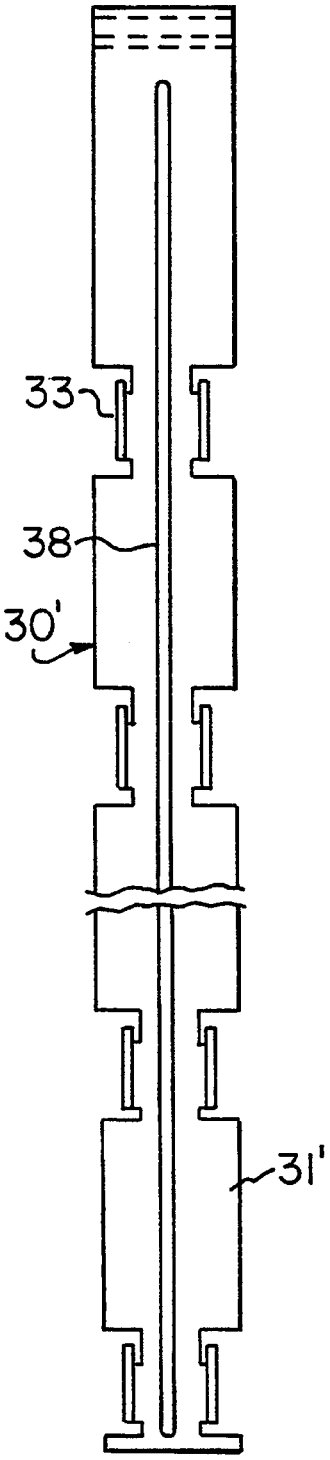
FIG. 8 is an elevation of the upper connecting bracket shown in FIG. 3.
Figure 9:
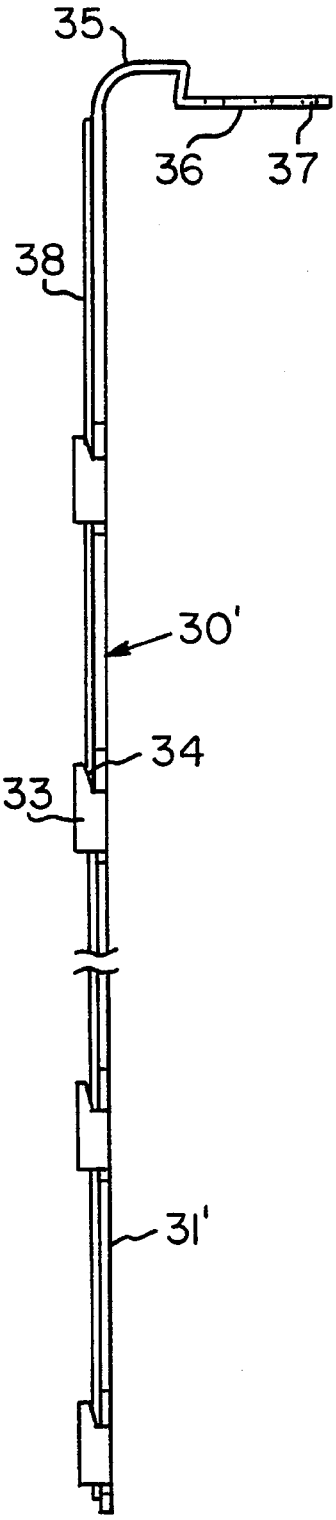
FIG. 9 is a side view of the upper connecting bracket shown in FIG. 8.

FIGS. 8–10 of the drawings show an upper bracket 30' having an elongated rib 38 formed on the lower section 31' for strength.

Figure 13:
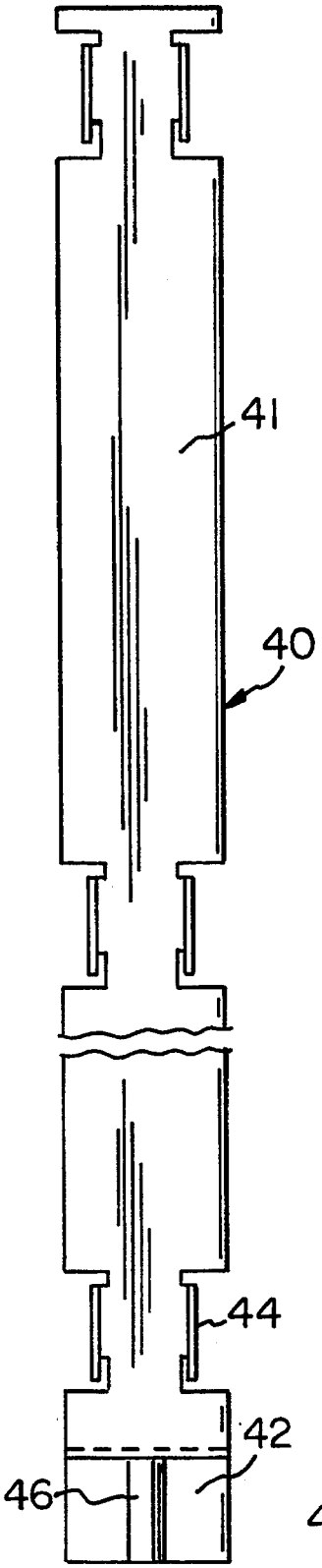
FIG. 13 is an elevation of a lower connecting bracket.
Figure 14:
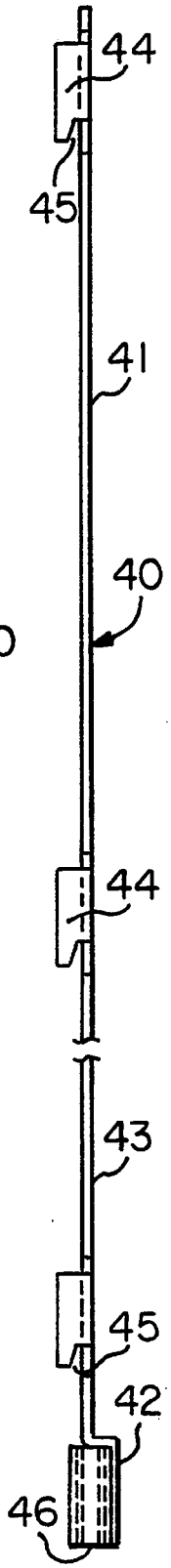
FIG. 14 is an end view of the lower connecting bracket shown in FIG. 13.
Figure 15:
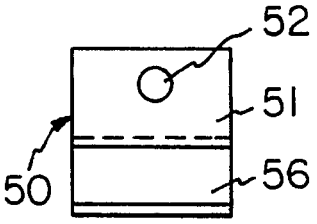
FIG. 15 is an elevation of an attachment member for use with the bracket shown in FIGS. 13 and 14.
Figure 16:
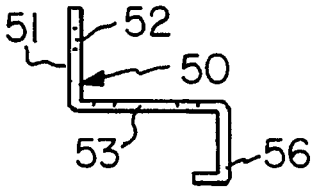
FIG. 16 is a side view of the attachment member shown in FIG. 15.
Figure 17:
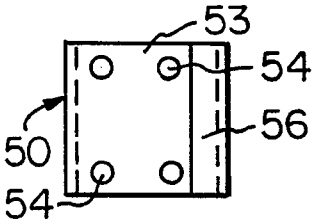
FIG. 17 is a plan view of the attachment member shown in FIG. 15.
Figure 18:
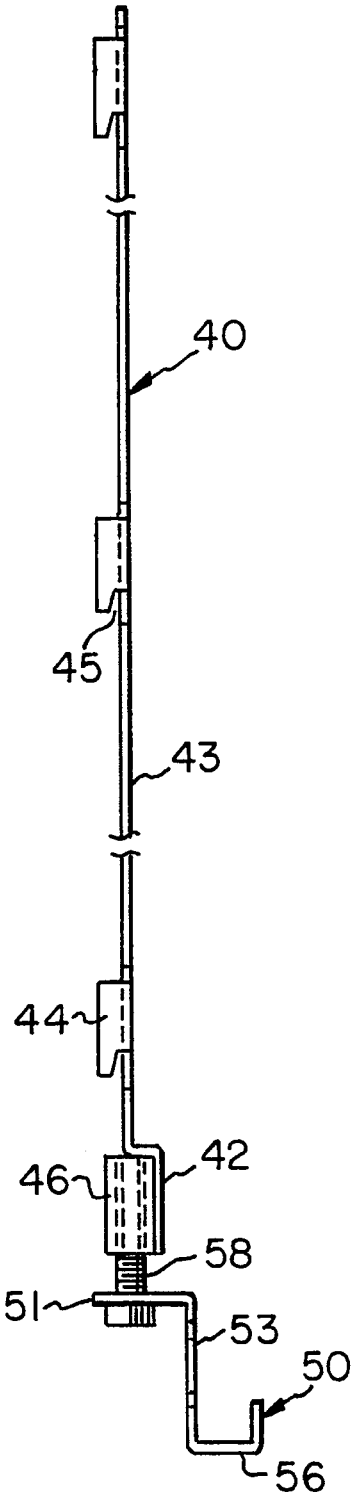
FIG. 18 is an end view of the attachment member on the lower mounting bracket.
Figure 19:
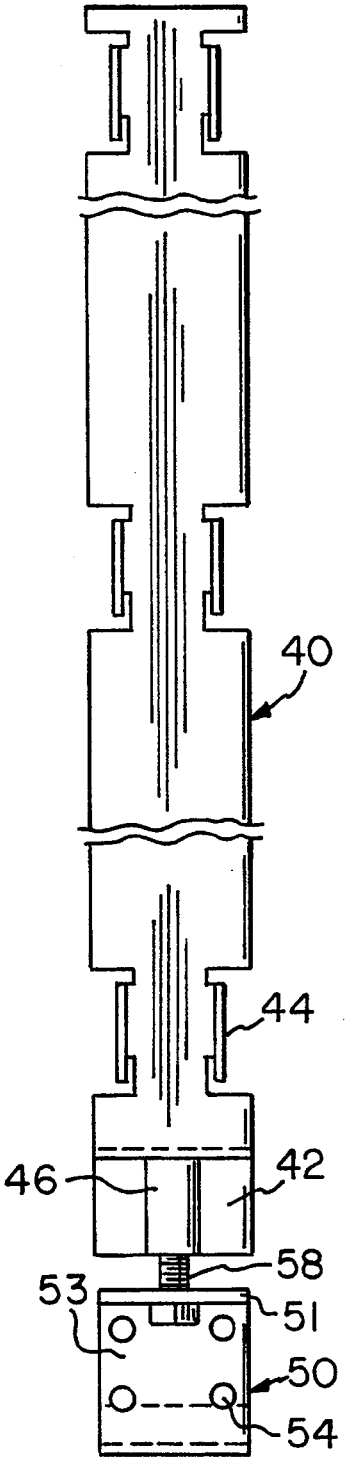
FIG. 19 is an elevation of the arrangement shown in FIG. 18.

The lower bracket 40 is shown in FIGS. 13 and 14 of the drawings includes an upper section 41 and a lower connecting extension 42. The surface 43 of the upper section 41 is adjacent to the surface 15 of the Teknion panel 10. A plurality of longitudinally spaced paired hooks 44 with notches 45 open downwardly to engage the edges of slots 25 near the bottom of the modified Steelcase finished end 18. The lower extension 42 of the lower bracket 40 includes an internally threaded socket 46 welded to a right angle portion of the lower extension to receive a jack bolt. FIGS. 15–17 show different views of an attachment member 50 which has a first leg 51 including a hole 52, a second leg 53 substantially perpendicular to the first leg 51 having holes 54 for screws to connect the attachment member 50 to the lower edge of a Teknion panel 10. Attachment member 50 also has a hook portion 56 extending from the second leg 53 which is adapted to lock on the lower edge of a Teknion panel 10. A jack bolt 58 extends through hole 52 into socket 46 to connect the attachment member 50 to the lower extension 42 as shown in FIGS. 18 and 19 of the drawings. It will be understood by those skilled in the art that attachment member 50 can be utilized without the hook portion 56 and that a strengthening rib may be used on the upper section 41 of lower bracket 40 if desired.

Figure 20:
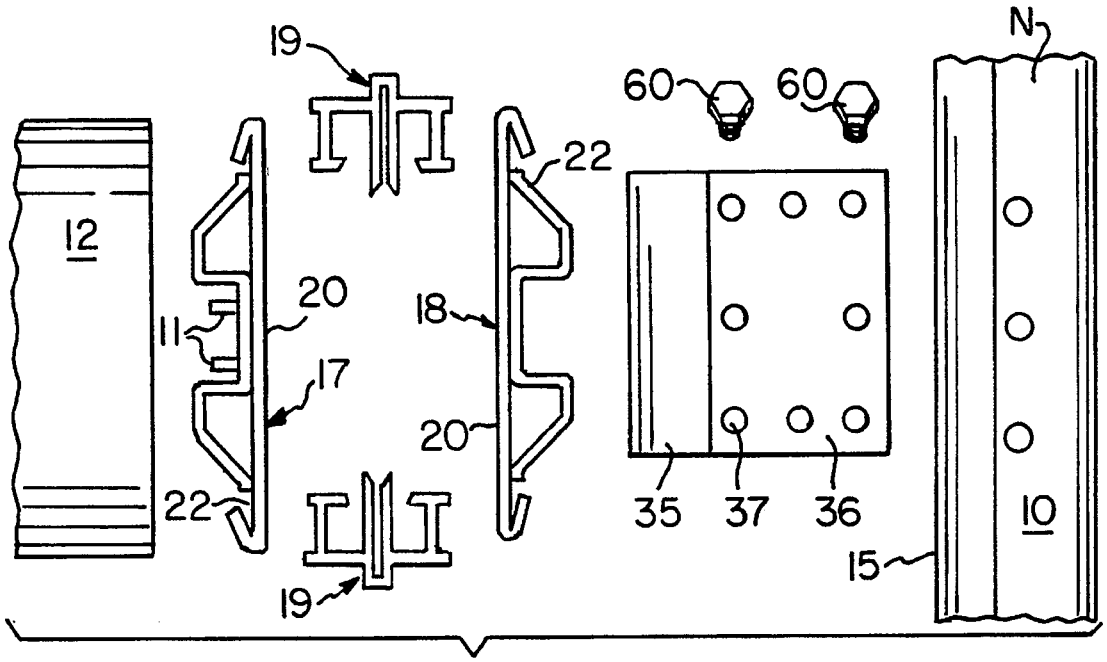
FIG. 20 is an exploded plan view of a connection between a Steelcase panel and a Teknion panel.
Figure 23:
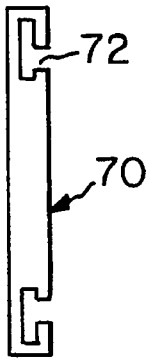
FIG. 23 is an end view of a Haworth wall starter.
Figure 25:
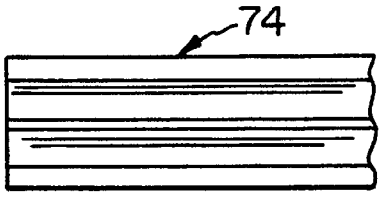
FIG. 25 is an elevation of the hinge shown in FIG. 24.
Figure 24:
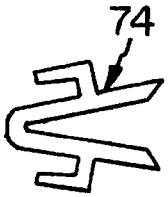
FIG. 24 is an end view of a Haworth flexible hinge.

FIG. 20 shows an exploded top view of an off module interface connecting arrangement for connecting a Steelcase panel 12 to a Teknion panel 10. The connection of the Steelcase panel 12 to the Teknion panel 10 is started by hanging the upper mounting bracket 30 on the Teknion panel 10 by the upper curved portion 35. A modified Steelcase finished end 18 is attached to bracket 30 by inserting the hooks 33 into the upper pairs of slots 25 as shown in FIG. 3 of the drawings. The upper section 41 of the lower bracket 40 is secured to attachment member 50 by a jack bolt 58 threaded into internally threaded socket 46. The lower bracket 40 is secured to the finished end 18 by inserting the hooks 44 into the lower pairs of slots 25 in the finished end 18. The attachment member 50 is attached to the lower bracket 40 by a jack bolt 58 and the hook portion 56 is inserted into a notch L. The finished end 18 is now plumbed on panel 10 after which self-tapping screws 60 are inserted into holes 37 in the flat extension in upper bracket 30 and holes 54 in the second leg 53 of attachment member 50 to hold the finished end 18 on the panel with an opposite end 22 facing the surface 15 of the panel.

The standard finished end 17 on a remanufactured Steelcase panel is connected to the end rail (not shown) of the panel. The edges 21 of the finished ends 17 and 18 are connected together by a pair of elongated hinge members 61.

Figure 26:
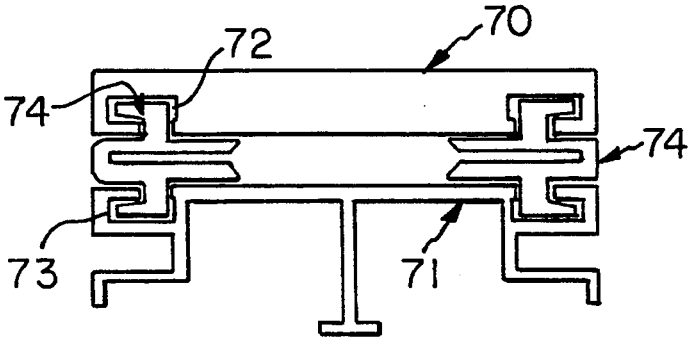
FIG. 26 is an end view of an assembled Haworth wall starter and a Haworth end rail with hinges in place.
Figure 22:
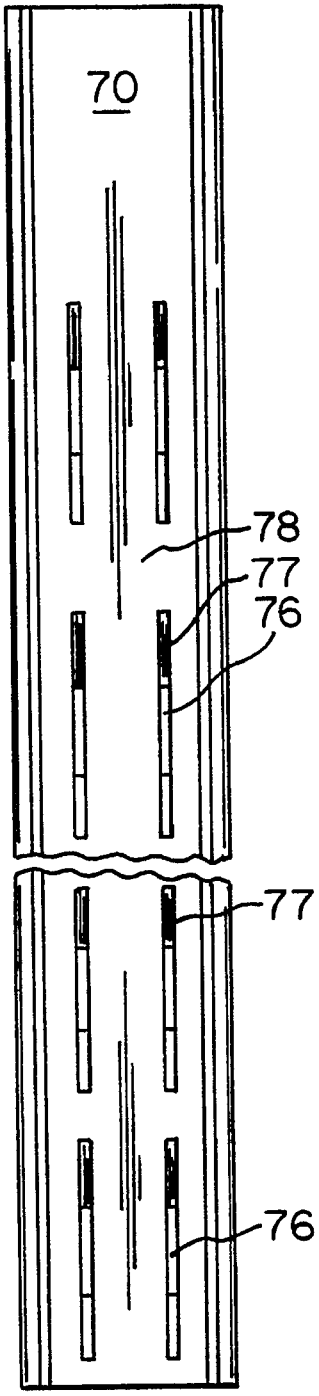
FIG. 22 is an elevation of a modified Haworth wall starter.
Figure 21:
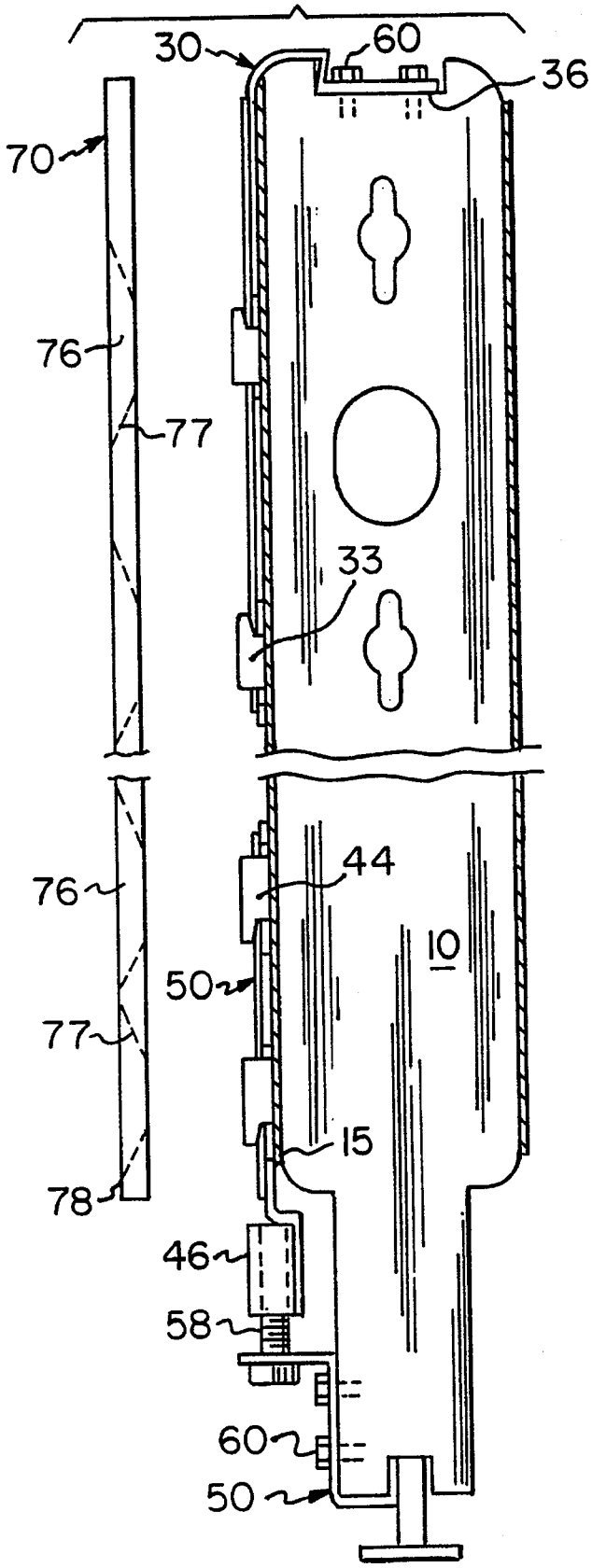
FIG. 21 is an exploded end view of a connection between a Haworth panel and a Teknion panel.

FIG. 21 of the drawings shows a modified Haworth wall starter 70 for connection to a Teknion panel 10 by the upper and lower mounting brackets 30 and 40. FIG. 26 shows a Haworth panel finished end 71 connected to a modified Haworth wall starter 70 by flexible hinge members 74. The modified wall starter 70 is connected to the finished end 71 on a remanufactured panel by the hinge members 74 in the grooves 72 formed in the wall starter 70 and the grooves 73 in the finished end 71. The wall starter 70 is modified by using a circular saw to cut slots 76 having angled end portions 77 which are approximately 14½° from the surface 78. The angled end portions 77 of the slots 76 engage the angled edges of the hooks 33 and 44 on the upper and lower brackets 30 and 40 as shown in FIG. 21. The slots 76 are cut to match the location of the hooks 33 and 44 and the angle of the edges of the hooks 33 and 44 is also 14½° to engage and lock into the end portions 77 of the slots 76.

A Haworth panel 12 is connected to a Teknion panel 10 in the same way as disclosed hereinabove for the connection of a Steelcase panel 12, except for the assembly of the finished end 71 and the modified wall starter 70.

Figure 27:
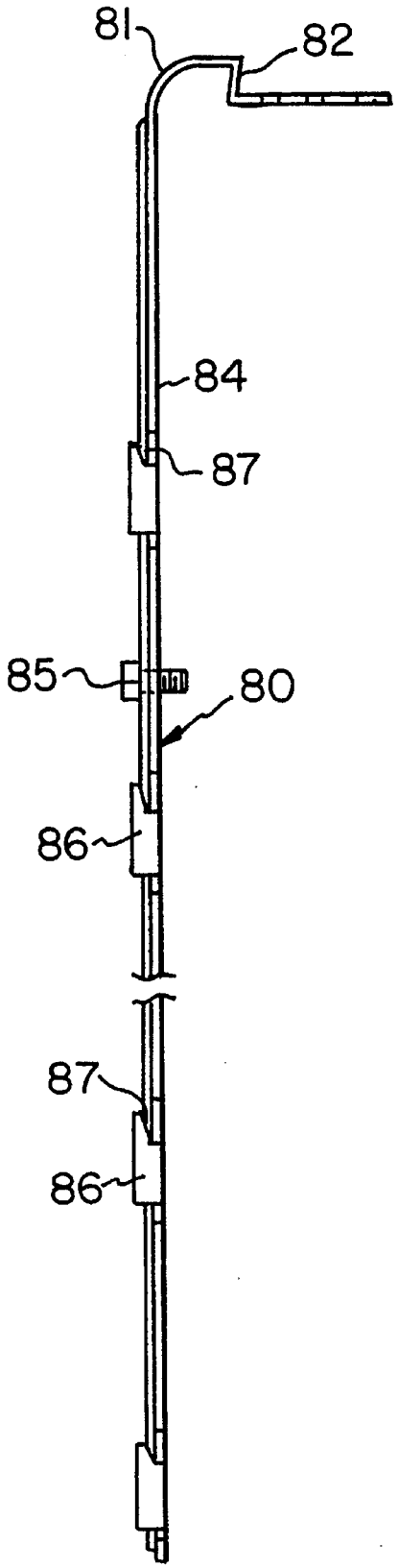
FIG. 27 is an end view of a mounting bracket for connection to a stringer in a Teknion panel.
Figure 28:
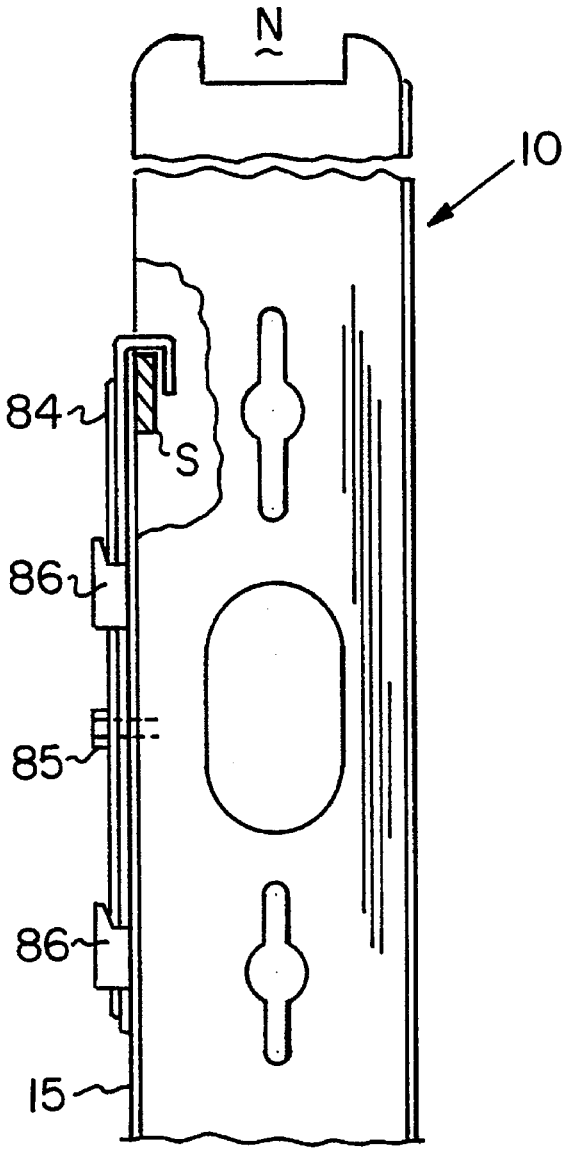
FIG. 28 is an end view of a Teknion panel with the connecting bracket shown in FIG. 27 attached thereto.

In another embodiment of the invention, an upper bracket 80 shown in FIGS. 27 and 28 of the drawings has a hook portion 81 on the upper end having a leg 82 to cooperate with a short Steelcase panel 14 that is mounted on a horizontal stringer S of a Teknion panel 10 to which it is connected. The Teknion panel 10 has substantially horizontal stringers S located at different heights which receive the hook portion 81 of a short panel so that the straight portion 84 of the bracket 80 contacts the surface of the Teknion panel 10. The bracket 80 has upwardly opening hooks 86 which form notches 87 and is secured to the Teknion panel 10 by a self-tapping screw 85 to hold the surface of the straight portion 84 against the surface 15 of the Teknion panel.

While the above discussion focuses on the connection of remanufactured Steelcase and Haworth panels to a Teknion panel, it will be understood by one skilled in the art that new Steelcase and Haworth panels may also be connected to a Teknion panel by the connecting arrangements of the present invention.

It is conceivable that panels other than Steelcase panels and Haworth panels can be connected to a Teknion panel using a modification of an embodiment of the off module interface connecting arrangement disclosed herein.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A connecting arrangement for connecting a spine panel having an upper edge and a lower edge to an end of a dividing panel at substantially a right angle, said connecting arrangement comprising:

an upper mounting bracket including a lower straight section and an upper curved portion extending from an end of said lower straight section, said upper curved portion having a flat extension for connection to the upper edge of a spine panel;

said lower straight section having a substantially planar surface adapted to lie adjacent to a surface of a spine panel and an opposing surface having a plurality of spaced hooks for engagement with a modified finished end;

a lower mounting bracket including an upper straight section and a lower extension;

said upper straight section including a substantially planar surface adapted to lie adjacent to a surface of a spine panel and an opposing surface having a plurality of spaced hooks for engagement with slots in the modified finished end;

a threaded socket attached to said lower extension; and an attachment member having a first leg with a hole formed therein, a second leg substantially perpendicular to said first leg and having at least one hole formed therein for connecting members, and a threaded bolt extending through said hole in said first leg into said threaded socket on said lower extension, whereby said bolt is tightened in said socket to hold said lower mounting bracket in place on a spine panel.

2. A connecting arrangement as set forth in claim 1, wherein said plurality of spaced hooks on said lower section of said upper mounting bracket includes pairs of hooks longitudinally spaced along said lower section and having upwardly opening notches adapted to engage with matching slots on a modified finished end of a dividing panel.

3. A connecting arrangement as set forth in claim 1, wherein said flat extension of said upper curved portion includes a plurality of holes for screws for insertion into the upper edge of a spine panel to secure said upper mounting bracket to the spine panel.

4. A connecting arrangement as set forth in claim 1, including a longitudinal rib on at least one of said lower straight section of said upper mounting bracket and said upper straight section of said lower mounting bracket.

5. A connecting arrangement as set forth in claim 1, wherein said plurality of spaced hooks on said upper straight section of said lower mounting bracket includes pairs of hooks longitudinally spaced along said upper straight section and having downwardly opening notches adapted to engage matching slots on a modified finished end of a dividing panel.

6. A connecting arrangement as set forth in claim 1, wherein said attachment member includes an attachment hook extending at a right angle from said second leg and adapted to lock on the lower edge of a spine panel.

7. A connecting arrangement as set forth in claim 1, including a modified finished end for a dividing panel for engagement with said plurality of hooks of said lower section of said upper bracket and said upper section of said lower bracket.

8. A connecting arrangement as set forth in claim 7, wherein said modified finished end has a surface and includes slots for engagement with said hooks.

9. A connecting arrangement as set forth in claim 7, wherein said modified finished end is free of studs.

10. A connecting arrangement as set forth in claim 7, wherein said modified finished end has a surface and includes slots adapted to engage said hooks.

11. A connecting arrangement as set forth in claim 10, wherein said slots include angled end portions of about 14½° from the surface of said finished end adapted to face a spine panel.

12. A connecting arrangement as set forth in claim 8, wherein said slots have angled end portions of about 14½° from the surface of said finished end adapted to face a spine panel.

13. The combination of a wall panel having an upper edge, a lower edge and a surface, and a connecting arrangement for connecting said wall panel to an end of a dividing panel located at substantially a right angle to said wall panel, said connecting arrangement comprising:

an upper mounting bracket including a lower straight section and an upper curved portion extending from an end of said lower straight section, said upper curved portion having a flat extension connected to said wall panel;

a plurality of holes formed in said flat extension;

said lower straight section having a substantially planar surface adjacent to a surface of said wall panel and an opposing surface having a plurality of spaced hooks for engagement with a modified finished end;

at least one connecting member extending through said at least one hole in said flat extension to connect said upper mounting bracket to said upper edge of said wall panel;

a lower mounting bracket including an upper straight section and a lower extension;

said upper straight section including a substantially planar surface adapted to lie adjacent to a surface of said wall panel and an opposing surface having a plurality of spaced upwardly opening hooks for engagement with slots formed in a modified finished end and a threaded socket attached to said lower extension; and an attachment member having a first leg with a hole formed therein, a second leg substantially perpendicular to said first leg and having at least one hole formed therein, a threaded bolt extending through said hole in said first leg into said threaded socket on said lower extension, whereby said bolt is tightened in said socket to hold said lower mounting bracket in place on said lower edge of said wall panel.

14. A combination as set forth in claim 13, wherein said plurality of spaced hooks on said lower section of said upper mounting bracket includes pairs of hooks longitudinally spaced along said lower section and having upwardly opening notches adapted to engage with matching slots on a modified finished end of a dividing panel.

15. A combination as set forth in claim 7, including a longitudinal rib on at least one of said lower straight section of said upper mounting bracket and said upper straight section of said lower mounting bracket.

16. A combination as set forth in claim 13, wherein said plurality of spaced hooks on said upper straight section of said lower mounting bracket includes pairs of hooks longitudinally spaced along said upper straight section and having downwardly opening notches adapted to engage with matching slots on a modified finished end of a dividing panel.

17. A combination as set forth in claim 7, wherein said attachment member includes a hook portion extending from said second leg embracing said lower edge of said wall panel.

18. An arrangement for connecting a first panel having an upper edge and a lower edge to an end of a second panel located at an angle to a first panel, said connecting arrangement including:

an upper mounting bracket having a lower section with an upper end and a portion extending from said upper end for connection to the upper edge of a first panel;

said lower section of said upper mounting bracket having a surface adapted to lie adjacent to a surface of a first panel and an opposing surface having means for engagement with an end of a second panel;

a lower mounting bracket having an upper section;

said upper section having a surface adapted to lie adjacent to a surface of a first panel and an opposing surface having means for engagement with an end of a second panel; and means for attaching said lower mounting bracket to a first panel.

19. The combination of a first panel having an upper edge, a lower edge and a surface, and an arrangement for connecting said first panel to an end of a second panel located at an angle to said first panel, said connecting arrangement including:

an upper mounting bracket having a lower section with an upper end and a portion extending from said upper end of said lower section connected to said first panel;

said lower section of said upper mounting bracket having a surface positioned adjacent to a surface of said first panel and an opposing surface having means for engagement with an end of said second panel;

a lower mounting bracket including an upper section;

said upper section of said lower mounting bracket having a surface positioned adjacent to a surface of said first panel and an opposing surface having means for engagement with an end of said second panel; and means for attaching said lower mounting bracket to said lower edge of said first panel.

20. An arrangement for connecting a first panel having a substantially flat surface with spaced substantially parallel vertical edges to an end of a second panel positioned at an angle relative to a surface of a first panel, said arrangement including:

an elongated mounting bracket for connection to a first panel intermediate the edges of a first panel;

said elongated mounting bracket having an upper portion and a lower portion;

said upper portion having a surface adapted to lie adjacent to a surface of a first panel and an opposing surface having means for engagement with an end of a second panel;

said lower portion having a surface adapted to lie adjacent to a surface of a first panel and an opposing surface having means for engagement with an end of a second panel; and means for attaching said elongated mounting bracket to a first panel.

21. The combination of a first panel having a surface with spaced substantially parallel vertical edges, a second panel positioned at an angle with respect to said surface of said first panel and an arrangement connecting said first panel to an end of said second panel, said arrangement including:

an elongated mounting bracket having an upper portion and a lower portion located between said spaced substantially parallel vertical edges of said first panel;

said upper portion having a surface adjacent to said surface of said first panel and an opposing surface having means for engagement with an end of said second panel;

said lower portion having a surface adjacent to said surface of said first panel and an opposing surface having means for engagement with an end of said second panel; and means for attaching said elongated mounting bracket to said first panel.

22. An arrangement for connecting a first panel having a surface to an end of a second panel positioned at an angle relative to the surface of a first panel, said arrangement including:

an elongated mounting bracket for connection to a first panel;

said elongated mounting bracket having an upper portion with an upper end and a lower portion with a lower end;

said upper portion having means on said upper end for connecting said mounting bracket to a first panel, a surface adapted to lie adjacent to a surface of a first panel and means for engaging with an attachment means for attaching said mounting bracket to an end of a second panel;

said lower portion having a means on said lower end for connecting said mounting bracket to a first panel, a surface adapted to lie adjacent to a surface of a first panel and means for engaging with an attachment means for attaching said mounting bracket to an end of a second panel; and adjustable means for supporting said lower end of said lower portion of said elongated mounting bracket on a first panel.

23. The combination of a first panel having a surface, a second panel positioned at an angle with respect to said surface of said first panel, and an arrangement connecting said first panel to an end of said second panel, said arrangement including:

an elongated mounting bracket having an upper portion with an upper end and a lower portion with a lower end;

said upper portion having means on said upper end for connecting said mounting bracket to said first panel, a surface positioned adjacent to said surface of said first panel and means for engaging with an attachment means for attaching said mounting bracket to an end of said second panel;

said lower portion having means on said lower end for connecting said mounting bracket to said first panel, a surface positioned adjacent to said surface of said first panel and means for engaging with an attachment means for attaching said mounting bracket to an end of said second panel; and adjustable means for supporting said lower end of said lower portion of said elongated mounting bracket on said first panel.

* * * * *

UNITED STATES PATENT AND TRADEMARK OFFICE

CERTIFICATE OF CORRECTION

PATENT NO. : 5,600,926

DATED : February 11, 1997

INVENTOR(S) : Michael F. Ehrlich

It is certified that error appears in the above-indentified patent and that said Letters Patent is hereby corrected as shown below:

Title page, [56] References Cited, U.S. Patent Documents, insert:

| | | | |
|---|---|---|---|
| 5,277,007 | 1/1994 | Hellwig et al. ... | 52/220.7 |
| 5,277,005 | 1/1994 | Hellwig et al. ... | 52/220.1 |
| 5,400,560 | 3/1995 | Hellwig et al. ... | 52/578 |
| 4,881,349 | 11/1989 | Brown et al. ... | 52/127.11 |
| 3,844,079 | 10/1974 | Karrip ... | 52/221 |

Column 1 Line 16 "Mich.." should read --Mich.--.

Column 6 Line 52 delete --adapted to lie--.

Claim 15 Column 7 Line 4 "as set forth in claim 7" should read --as set forth in claim 13--.

Claim 17 Column 7 Line 13 "as set forth in claim 7" should read --as set forth in claim 13--.

Signed and Sealed this

Seventh Day of October, 1997

*Attest:*

*Attesting Officer*

Bruce Lehman

BRUCE LEHMAN

*Commissioner of Patents and Trademarks*